United States Patent [19]

Van Wagoner

[11] Patent Number: 4,719,723

[45] Date of Patent: Jan. 19, 1988

[54] THERMALLY EFFICIENT, PROTECTED MEMBRANE ROOFING SYSTEM

[76] Inventor: John D. Van Wagoner, 8554 Georgetown Pike, McLean, Va. 22101

[21] Appl. No.: 783,525

[22] Filed: Oct. 3, 1985

[51] Int. Cl.[4] ..... E04B 5/00; E04B 7/00; B32B 5/32

[52] U.S. Cl. ..... 52/15; 52/309.4; 52/472; 52/302; 52/408

[58] Field of Search ..... 52/302, 303, 309.4, 52/309.8, 309.9, 416, 417, 418, 419, 408, 15, 472, 459

[56] References Cited

U.S. PATENT DOCUMENTS

| | | | |
|---|---|---|---|
| 3,411,256 | 11/1968 | Best | 52/408 |
| 3,598,688 | 8/1971 | Bellamy | 52/302 |
| 3,817,009 | 6/1974 | Elder | 52/199 |
| 3,971,184 | 7/1976 | Van Wagoner | 52/515 |
| 4,063,395 | 12/1977 | Stewart | 52/309.8 |
| 4,274,238 | 6/1981 | O'Riordain | 52/408 |
| 4,368,604 | 1/1983 | Spielau | 52/411 |
| 4,651,494 | 3/1987 | Van Wagoner | 52/593 |

OTHER PUBLICATIONS

Sweet's Catalog File 1979, 7.15 Be, pp. 9–11.

*Primary Examiner*—John E. Murtagh
*Attorney, Agent, or Firm*—Bradford E. Kile

[57] ABSTRACT

A thermally efficient, protected membrane roofing system for insulating the interior of a building including a water impermeable membrane (26) and an array of factory assembled roofing panels including a drainage and insulation board (42), a vapor barrier course (44) and an insulation course (46). The seams between adjacent roofing panels is covered with a water proof, but vapor permeable, tape (48) and the panels are covered with a protective layer (50).

6 Claims, 5 Drawing Figures

FIG. 1
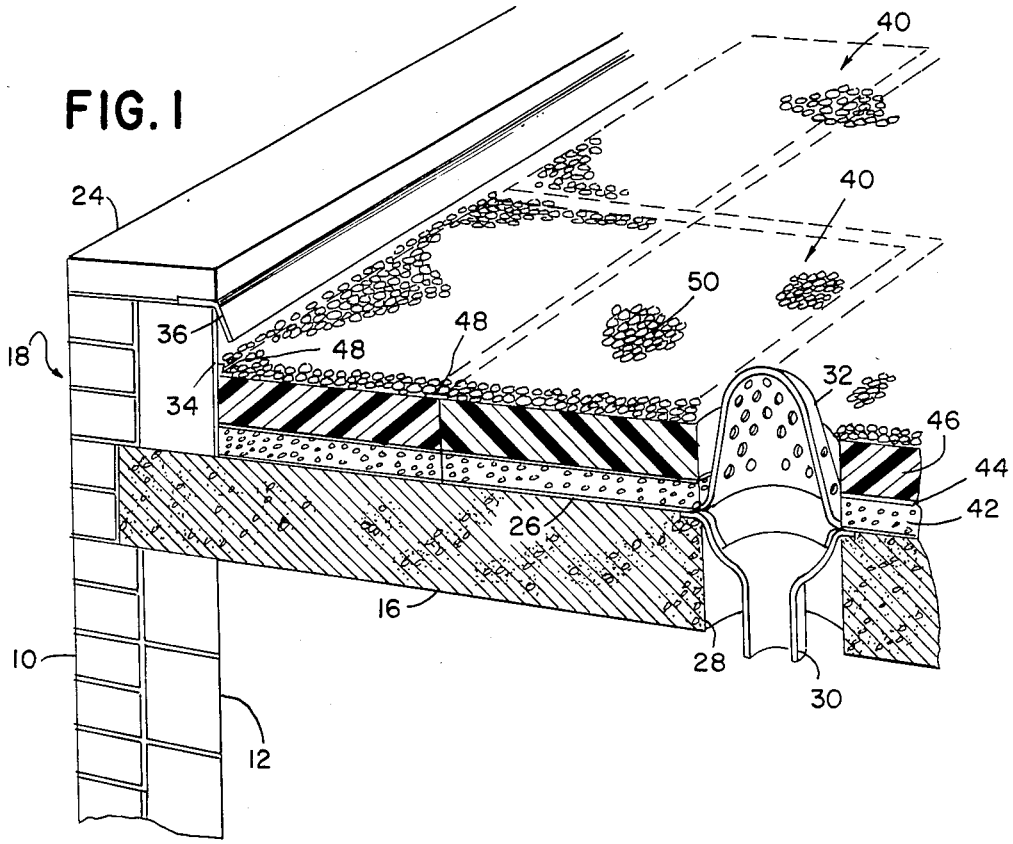
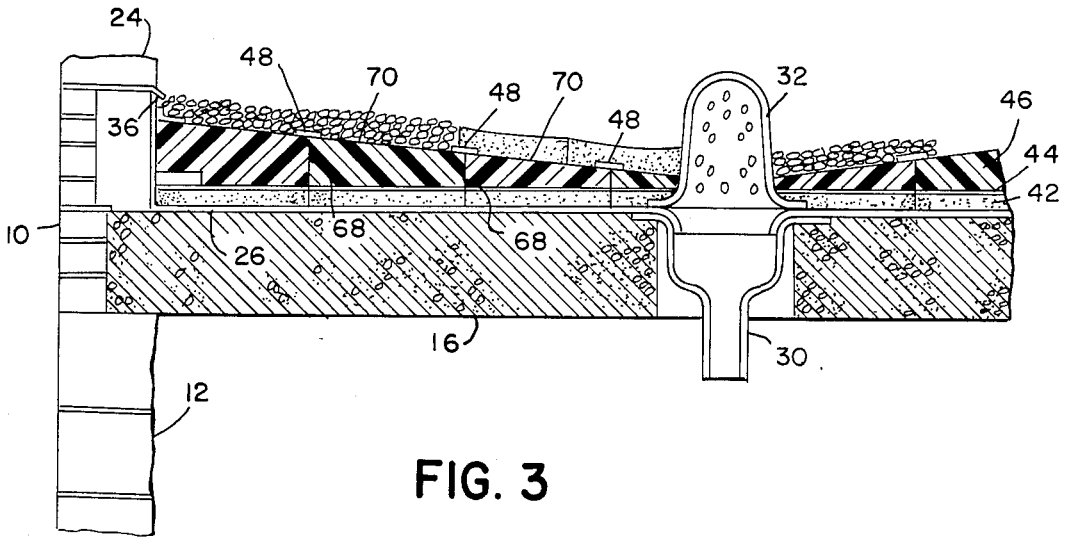
FIG. 3

THERMALLY EFFICIENT, PROTECTED MEMBRANE ROOFING SYSTEM

RELATED APPLICATION

This application is related to the subject matter of applicant's prior application U.S. Pat. No. 3,971,184 entitled "Insulated Water Impermeable Roofing System" and to the subject matter of applicant's prior U.S. Pat. No. 4,551,494 entitled "Insulation Panel For A Roofing System Or the Like."

BACKGROUND OF THE INVENTION

This invention relates to an improved thermally efficient protected membrane roofing system or the like for commerical buildings, deck structures and similar structures. More particularly, this invention relates to a protected membrane roofing system for insulating the interior of a building from ambient thermal cycling and for insuring water impermeable integrity of the roofing membrane.

The basic concept of a roof is to act in cooperation with wall surfaces to form an enclosed space which may be isolated from an ambient environment and thus may be temperature and humidity regulated in accordance with intended utilization.

A threshold or common denominator of almost all controlled environments is to maintain the enclosure in essentially a water tight or dry condition. Accordingly over the years the roofing industry has attempted to maintain a water tight or water impermeable roof condition by building a water impermeable barrier, in situ, upon a roof substructure or deck. Such a water barrier has typically assumed the configuration of a laminar composite comprising a plurality of bituminous felt layers with intercalated courses of mopped on bituminous composition.

In many previously known installations, bituminous compound arrives at a job site in solid cylinders. The cylinders are melted in a heater and the hot liquid is then carried in buckets to a roof deck where it is mopped onto a previously prepared roof substructure. A roll of bituminous impregnated felt paper is then carried to the roof and unrolled upon the hot bituminous compound which binds the felt to the roof deck. Three or more courses are then built up over the entire roof structure. The job is finished with a layer of topping gravel. The gravel weights down the felt courses and also serves as a shield to minimize ultra-violet degradation of the felt and bituminous membranes.

Although water impermeable roofing membranes, as previously noted, have been widely utilized in the roofing industry substantial disadvantages have been occasioned. In this connection, elevated roof temperatures may vaporize volatile components in the bituminous compound. The compound then tends to harden and crack in a checkered or "allegator" array. Moreover as the bituminous compound becomes hot during the summer months the overlay course of gravel tends to sink into the membrane. Further, prior roofing systems often developed vapor blisters, splitting or ridging. Similar problems of accelerated aging occur with elasto-plastic membranes where the roofing membrane is placed on top of insulation.

The above factors each tended to create water seepage difficulties which ultimately rendered the waterproofing system unsuitable for its intended purpose.

In addition to water impermeability considerations environmental control criteria dictates internal isolation from thermal cycling which takes place at the exterior surface of a roof. More particularly the exterior surface of a roof may experience temperatures during midsummer as high as 180° Fahrenheit while a winter cold front may drop the temperature as as low as 20° or 30° below zero. The interior surface of the roof, however, should optimally be maintained at a desired interior temperature which typically is 65° to 75° Fahrenheit.

In order to provide thermal protection, an initial practice entailed lining the interior surface of the roof with an insulation composition such as sprayed or layered glass fibers, fiberboard, plastic foams and the like. While such insulation techniques operably reduced thermal cycling problems it severely accentuated the previously outlined difficulties occurring with the felt and bituminous water barrier by isolating the barrier from a relatively stable interior temperature of the building structure. Accordingly, in the past it was not uncommon for roof membranes to require considerable attention and short term replacement.

A significant advance was made in the roofing industry when it was determined that an insulation course could be installed exteriorly on top of the felt and bituminous water barrier. The exterior insulation provided a building with isolation from thermal gradients and concomitantly physically protected the felt and bituminous waterproofing barrier from environmental and physical abuse.

In the above connection, an insulated roof membrane assembly which has attained at least a degree of industry recognition comprise a water barrier of felt and bituminous lamination which is built up, in situ, in a manner as previously discussed. A hot course of bituminous compound is then mopped upon the final layer of felt and generally rectangular panels of polystyrene are laid over the membrane. The polystyrene insulating members are loosely abutted adjacent each other to permit a peripheral drainage channel and a heavy course of aggregate is applied directly upon the upper surface of the thermal insulating members to hold the members in place and isolate the insulation surface from ultra-violet degradation.

Although the above and similar systems have achieved a wide degree of industry utilization, room for significant improvement remains. In this regard, little attention has been directed in the past, to the combination effects of three interrelated factors: (1) external standing water, (2) external moisture, and (3) internal moisture vapor driven from the interior of a building outward. These three factors must be concomitantly addressed and accommodated in order to achieve a thermally efficient roof.

Previously known systems, have been designed to specifically channel water from rain or melting snow from the top surface of the insulation down to the roofing membrane where the water travels across the membrane to roof drains. These prior systems promote the passage of water freely either thru the insulation or thru the joints in the insulation onto the roofing membrane. As a result of such prior construction, buildings covered with these roofing systems loose a significant amount of heat energy in the winter as the water travels over the membrane surface to the roof drains. It is believed that at least a 12% increase in insulation thickness would be required to offset such energy loss in Sweden.

The loss of thermal efficiency could be even greater in colder climates.

In addition to thermal inefficiency occasioned in prior insulated roof membrane assemblies, which permit rain water to seep downwardly around lines of panel abutment, water may migrate beneath panels and lift or float the roofing system. In order to obviate this tendency of the insulation to float, a substantial amount of gravel needs to be applied directly to the insulation course in order to maintain it in place. In this connection gravel may be deposited at a rate of 1,000 pounds or more per 100 square feet. The roof deck must therefore be designed to support a considerable amount of weight.

Additionally, rain water which collects in insulation fissures and beneath the insulation panels in prior systems can, over time, permeate and degrade the insulation.

In at least one prior instance it has been invisioned that, in order to reduce the amount of water that is permitted to accumulate between an insulation board and a waterproof roofing membrane, a drainage board of polystyrene beads is positioned beneath an insulation layer. The drainage board is composed of polystyrene beads which have been expanded within a steam mold and self adhered in a loose array at points of contact. This drainage board permits water penetrating the peripheral zone of the insulation course to be drained off of the roof. However, this drainage layer itself is subject to moisture saturation and degradation over time.

In addition to external standing water and moisture, another significant factor in a thermally efficient roofing system, as mentioned above, is moisture vapor driven from the interior of a building outward. More specifically, moisture vapor emanating, from the interior of a building, tends to permate an overlaying insulation layer during a cold cycle when moisture vapor drives are outward.

In the prior art this problem of moisture vapor and its long term adverse effect on an insulation course in a protected membrane roofing system has not been addressed.

The problems suggested in the preceeding are not intended to be exhaustive, but rather are among many which may tend to reduce the effectiveness of prior insulated roofing membrane systems. Other noteworthy problems may also exist; however, those presented above should be sufficient to demonstrate that protected membrane roofing systems appearing in the past will admit to worthwhile improvement.

OBJECTS AND SUMMARY OF THE INVENTION

Objects

It is therefore a general object of the invention to provide a thermally efficient, protected membrane roofing system or the like which will obviate or minimize problems of the type previously described.

It is another object of the invention to provide a thermally efficient, protected membrane roofing system or the like which will be resistant to the accumulation of external standing water even on a generally flat roofing deck.

It is yet another object of the invention to provide a thermally efficient, protected membrane roofing system or the like wherein a tendency of the insulation to be lifted from underlying water is minimized.

It is still another object of the invention to provide a thermally efficient, protected membrane roofing system wherein insulation properties of the system are maintained even after long term weather exposure.

It is another object of the invention to provide a thermally efficient, protected membrane roofing system wherein removal of external water and moisture is facilitated from beneath the insulation panel.

It is a further object of the invention to provide a thermally efficient, protected membrane roofing system or the like wherein the insulating characteristics of an insulation panel are enhanced and prolonged.

It is a related object of the invention to provide a thermally efficient, protected membrane roofing system or the like wherein a tendency for the migration of water vapor into the insulation is minimized.

It is an overall object of the invention to provide a thermally efficient, protected membrane roofing system which will be permanent that is, will last as long as other major building members.

BRIEF SUMMARY OF THE INVENTION

One preferred embodiment of the invention which is intended to accomplish at least some of the foregoing objects comprises a thermally efficient, protected membrane roofing system comprising an association of interconnected insulating roofing panels. Each panel preferably comprises a laminated composite of an insulating drainage course, a moisture vapor retardant course and a closed cell insulation course. The insulating drainage course comprises a generally homogeneous association of expanded polystyrene spheres which are enrobed with a layer of water proofing material and bonded together at points of contact with random voids created throughout the association to render the course both insulating and substantially porous to the passage of water. The insulating drainage course is operable to be placed on top of a waterproofing membrane. A moisture vapor retardant layer is interposed between the insulating drainage course and a closed cell insulation course and is composed of a material operable to retard the flow of moisture vapor into the closed cell insulation. The insulation course is composed of an expanded polystyrene or similar insulating material and is adhered to the moisture vapor retardant layer to form a laminated, composite panel structure.

The composite panel is operably positioned upon an elasto/plastic or built up water impermeable roofing membrane which is built-up or deposited upon a building roof or deck. The panels are placed edge-to-edge with the insulating drainage course positioned against the water impermeable course of the roofing system. The seams around the panel are then covered with a waterproof tape, which is concomitantly water vapor permeable, to prevent external water from passing into the roofing system while permitting water vapor to exit from beneath the insulation course. An external layer of aggregate, pavers or similar ballast is deposited on top of the insulation course of the panels to maintain the panels in position and to protect the closed cell insulation course from solar degradation, improve fire resistance, prevent wind blow off, etc.

The course of waterproofed expanded polystyrene spheres enables external water, which inadvertently passes downwardly into the system, to rapidly migrate to a conventional drain system. Since occasional water easily passes into and laterally through the first drainage course, the tendency of such water to float the composite panel is minimized.

The initial course also provides a degree of insulation for the underlying water impermeable membrane. The closed cell insulation course, however, has a higher R-rating and provides the primary insulation characteristic of the composite roofing system. The moisture vapor retardant layer isolates the closed cell insulation from water vapor which raises upwardly from vapor within the building structure, or water from the surface of the roofing membrane which, over time, can migrate through the roofing membrane.

The high degree of moisture vapor impermeability of the intermediate vapor barrier layer as compared with the peripheral joints or gaps around the panels, insures that water vapor escapes into the atmosphere around the panels and not through them. This prolongs the life of the insulation course and enhances its insulating characteristics. The waterproof tape physically retains the panels in place and prevents exterior water from freely penetrating the system. It also reduces chances of wind blow off by reducing air passage to the underside of the panel. Any occasional water that does penetrate is rapidly drained away by the insulation drainage course. At the same time the water vapor permeable nature of the tape permits water vapor to escape from the building around the periphery of the insulation panels. Similar advantages may be achieved by tongue and grove panel installation or two layers of unsulation, with joints offset.

In order to decrease the possibility of occasion water penetrating the upper surface of the closed cell insulation layer, this layer may be advantageously sloped toward a water drainage outlet.

THE DRAWINGS

Other objects and advantages of the present invention will become apparent from the following detailed description of preferred embodiments taken in conjunction with the accompanying drawings, wherein:

FIG. 1 is an axonometric view of a building or enclosure including a roof deck with an array of insulation panels applied to an upper surface of the roofing deck, comprising a thermally efficient, protected membrane roofing system in accordance with one embodiment of the invention;

Figure 4:
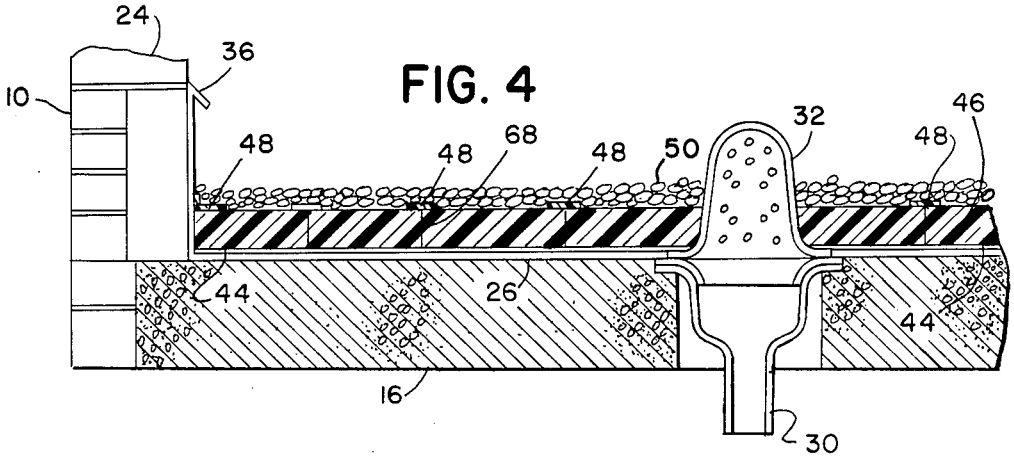
Figure 5:
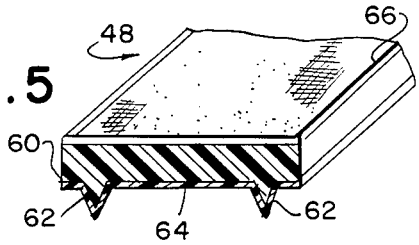

FIG. 3 disclosed a cross-sectional detailed view of another preferred embodiment of the invention including a sloping upper surface of the closed cell insulation panels;

FIG. 4 comprises a cross-sectional detailed view of still another embodiment of the invention which does not utilize an insulation drainage panel; and FIG. 5 is an axonometric, detail view, in cross-section of one embodiment of a waterproof tape in accordance with the invention.

DETAILED DESCRIPTION

Referring now to the drawings wherein like characters indicate like parts there will be seen in various preferred embodiments of the subject invention. Before describing these various embodiments in detail, however, it may be useful to address the operating context of the invention.

CONTEXT OF THE INVENTION

Referring now particularly to FIG. 1, an axonometric view can be seen of a general operative environment of the invention. In this regard, a wall is shown composed of a conventional brick 10 and block 12 construction and a generally horizontally extending expanse of concrete 16 which is operable to form a structural roof and/or deck or the like. The structural roof or deck 16 can be constructed of a variety of materials such as cast in place or precast concrete, metal sheets on bar joists, wood sheets or planks on wood joists or a variety of prefabricated panels designed to accommodate roofing systems. A brick and block extension 18 is formed around the periphery of the roof or deck as an extension of the wall and terminates with a conventional capping 24 of tin, copper, stone, or other suitable material 24.

A water impermeable roofing membrane 26 has been applied to the roof or deck surface 16 by a conventional technique such as multiple applications of felt paper and hot melt bituminous compound as outlined above or an elasto/plastic single ply membrane such as modified bituminous membranes, polyvinyl chloride, ethylene propylene diene monomer, etc. The roof or deck surface 16, while being generally flat, can be sloped to a degree toward rain water openings 28 at various locations along the surface and a generally vertical drain pipe 30 is positioned within the openings 28. Each drain pipe is typically fitted at an upper end with a drain cover 32 having a plurality of apertures suitable to permit water to enter into the drain while isolating the drain from particulate debris.

The water impermeable membrane 26 is extended upwardly along the periphery of the roofing system as at 34 and a downwardly extending flashing 36 covers an upper end of the membrane 34. Accordingly, water which falls on the roof surface, such as by rain or snow, is normally collected upon the generally horizontal deck surface and migrates by gravity toward the vertical drains 30 in a manner well known in the roofing industry.

The structure depicted in FIG. 1 is intended to be illustrative and not exhaustive and serves to identify at least one area in the building industry where a water and vapor membrane such as 26 is utilized to isolate the interior of a structure from moisture. Such membranes, or their equivalent, may also be affixed to other portions of the building such as around the foundations or below grade wall surfaces.

THERMALLY EFFICIENT, PROTECTED MEMBRANE ROOFING ASSEMBLY

In order to isolate the water impermeable membrane 26 from ultra-violet degradation, thermal cycling and the impingement of sharp objects and the like, the membrane is protected by a plurality of factory-assembled, insulation panels 40. Each panel 40 is composed of a lamination of an insulating drainage course 42, a moisture vapor barrier 44 and a closed cell insulation course 46. The seam between adjacent panels 40 is covered by a waterproof, but vapor permeable, tape 48 (note FIG. 2). An overlaying course of gravel or particulate matter, or an array of pavers, is laid on top of the panels 40 to provide weight, isolate the insulation course 46 from ultra-violet degradation and add fire resistance.

Turning specifically to the insulating drainage course 42, it is composed of a generally homogeneous association of expanded polymeric spheres. The spheres are coated or enrobed with a water proofing material such as a water resistant bituminous material.

The spheres 50 are composed of a plurality of expanded or extruded polystyrene which are lightly bonded together at random touching surface locations. Sphere bonding can be accomplished with a light coating of a latex bituminous emulsion or similar adhesive. The beads are bonded together as spheres as opposed to being deformed into a solid mass. This relatively open formation creates voids, represented at 54 in FIG. 2, between adjacent spheres in a random three-dimensional array. The voids permit water to migrate throughout the member 42.

The bonding of the lightly touching spheres creates an essentially homogeneous association of expanded polystyrene beads which form a resilient insulation member. This degree of resilience provides a form of protection for the underlying water impermeable membrane 26 from the impingement of sharp objects and the like which might otherwise pierce the membrane.

The size of the spheres may be varied with different panels depending upon whether maximum drainage or insulation is desired. Moreover, the size of the spheres within any panel may be random. However, it has been determined that optimum results of insulation, protection and drainage are achieved when the panel is fashioned with spheres having a diameter of from 0.317 centimeters to 1.27 centimeters.

Further while a spherical configuration of the beads is preferred, other three dimensional shapes are contemplated by the subject invention such as cubes, solid rectangles or other polyhedron configurations and the like as desired.

Materials other than polystyrene may be used in practicing the invention such as polyisocyanurate, polyurethane and the like. Moreover the drainage layer 42 could be constructed of other materials such as gravel or stone aggregate, spheres of glass or drainage size particles of other material. However, bituminous coated water resistant polystyrene spheres are preferred due to their insulating characteristics and resistance to penetration by water.

The moisture vapor barrier 44 overlays a surface of the insulating drainage course 42 in a position operably remote from the roofing membrane 26. The moisture retardant may be composed of a metallic foil or synthetic polymeric sheet having a high resistance to vapor penetration. This sheet may be adhered between the drainage board 42 and the closed cell insulation 46 by conventional adhesive compositions. Alternatively the vapor barrier may be composed of a specially selected adhesive which may be utilized with or without a separate foil layer to provide a vapor barrier. In this connection, materials which have been found to exhibit particular utility for the instant invention includes petroleum based bituminous resin, plasticized with high molecular weight polymeric additives or unvulcanized synthetic rubber, neoprene or butyl rubber compositions, polyurethane elastomeric materials, polysulfide elastomeric materials, silicone elastomeric materials, acrylic elastomeric materials and polyethylene or polyvinyl chloride compositions. The most preferred composition for the water and vapor barrier 44 comprises a petroleum based, bituminous resin, plasticized with high molecular weight polymeric additives or unvulcanized synthetic rubber.

The insulation course 46 is composed of a closed cell insulating material. Such an insulation material may be selected from a polystyrene family of expanded foams, polyurethane or polyvinyl fluoride family of foams, foam glass or glass beads, insulating concrete or bituminous blocks or phenolic resin or a combination of phenolic and expanded polystyrene. While it is anticipated that the foregoing materials are operative, it has been found that polystyrene expanded foam is the most preferred and possesses markedly superior performance properties, when used as described herein, to other known materials.

Figure 2:
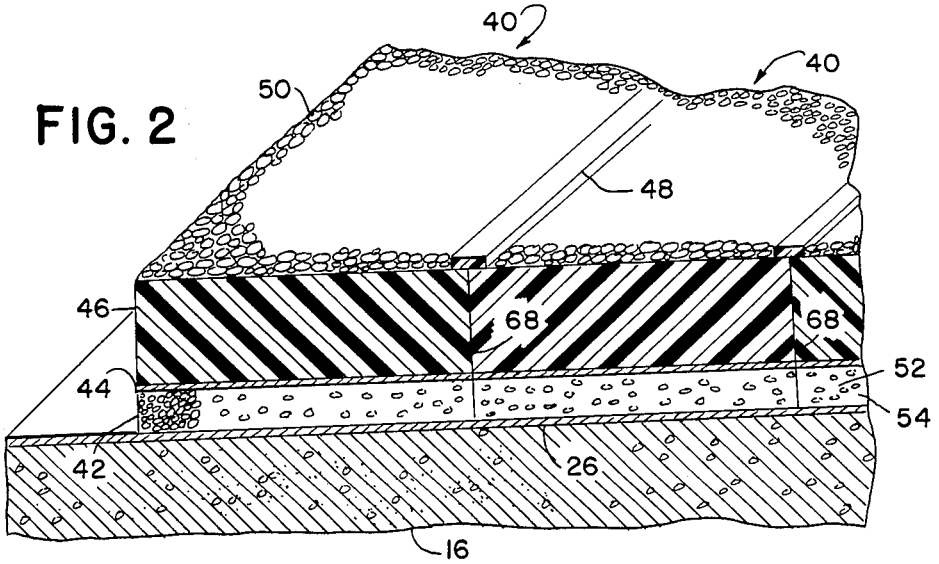
FIG. 2, is an axonometric detail view of insulation panels which has been broken away to disclose in further detail features of the subject roofing assembly including a waterproof tape along abutting edges of the roofing panels.

In order to isolate the insulation from standing water and promote surface drainage the subject insulation drainage system further includes a waterproof, but vapor permeable, tape 48 (note particularly FIGS. 2 and 5). The tape 48 can be constructed of a variety of materials such as polyethylene, polyvinylchloride, polyurethane, various rubber products or similar materials that are compatible with the insulation and that are water impermeable. The waterproof tape prevents water on top of the insulation layer 46 from finding a passage to the surface of the roofing membrane 26 where it could have an adverse effect on the thermal efficiency of the building. The waterproof tape also reduces thermal bridging, thus further enhancing roof thermal efficiency (Thermal bridging as used herein occurs when open joints in the insulation permit heat to escape from the building interior.)

As shown specifically in FIG. 5, the waterproof tape 48 may be composed of a generally flat body portion 60 and have a plurality of downwardly directed anchor cones 62 aligned in a row along the edge of the tape and longitudinally spaced every quarter of an inch to one inch or so. The cones provide a means of physical penetration of the tape 48 into an upper surface of the insulation to structurally bind edges of adjacent panels 40 together.

Moreover the lower surface of the tape 48 is coated with an adhesive 64 which is selected to adhesively bind to the upper surface of adjacent insulation boards 46. Accordingly adjacent panels 40 may be adhesively and mechanically bound together or adhesively bound in the event the tape is constructed without cones 62.

The tape 48 may be composed of a polymer modified asphalt which is formulated to remain flexible and retain its adhesive quality. Acceptable polymers would be atactic polypropylene (APP), styrene butadiene styrene (SBS), styrene butadiene rubber (SBR) or ethylene propylene diene monomer (EPDM).

The top surface of the tape may be covered with a water vapor permeable fabric material 66 such as polyproplene or polyester random weave fabric, fiberglass fabric, nylon fabric or similar vapor permeable material.

It may also be possible to omit any top surface over the polymer modified bituminous tape or to leave a release paper on the top surface of the tape which will eventually disintigrate.

The tape 48 is depicted in the drawings as being rather thick for ease of illustration, however, in practice the tape will be quite thin relative to the thickness of the insulation course 46 and serves, in cooperation, with the upper surface of the insulation 46 to provide a generally planar surface for rain water to be rapidly drained to the surface drains 30.

In addition to being water impermeable, the tape 48 is selected to be vapor permeable to an extent greater than the closed cell insulation 46. Accordingly vapor driven outwardly from the building will pass through abutting edges of the insulation as at 68, note FIG. 2, and outwardly through tape 48 to the atmosphere without penetrating and degrading the insulation 46.

Turning to FIG. 3, there will be seen another preferred embodiment of the subject invention comprising a thermally efficient permanent roofing system or the like. In this embodiment the outer insulation panels 46 are fashioned with a sloping surface 70 which descends toward drain 30. The seams 68 in the insulation panels 46 are each covered with a waterproof tape 48 as described above. Accordingly rain water or melting snow will be guided by the upper surface of the insulation into the surface drains.

FIG. 4 discloses yet another embodiment of the invention wherein the insulation drainage course 42 is not utilized. The vapor barrier 44 is applied directly or through an adhesive to the waterproof membrane 26. Each of the seams 68 of the insulation panels 46 are sealed with a waterproof, but vapor permeable, tape 48 as described above. This embodiment of the invention has been found to be most useful in those areas where there is low rainfall and/or where the slope of the roof promotes rapid surface drainage and thus there is no need for a sub-insulation drainage course.

SUMMARY OF MAJOR ADVANTAGES OF THE INVENTION

In describing a thermally efficient, membrane protected roofing system or the like in accordance with preferred embodiments of the invention, those skilled in the art will recognize several advantages which singularly distinguish the subject invention from the heretofore known prior art. A particular advantage of the subject invention is the provision of a thermally efficient roofing system wherein rain water is maintained essentially out of contact with a waterproofing membrane 26.

The instant roofing system promotes rapid surface water drainage and runoff without subjecting the insulation to standing water and the like.

The vapor barrier layer 44 prevents outward vapor drive from saturating the insulation over time and/or compromising the thermal insulating qualities of the insulation through vapor degradation.

The waterproof tape 48 provides a mechanical and/or adhesive capability of holding the insulation panels together in a roofing system. The tape 48 is designed to be waterproof to promote surface drainage while being vapor permeable to enable water vapor driven outwardly to escape through seams 68 into the atmosphere.

The insulation panels 48 may be fashioned with a slope toward drainage outlets to further promote surface drainage of external water such as rain or snow.

In describing the invention, reference has been made to preferred embodiments. Those skilled in the art, however, and familiar with the disclosure of the subject invention, may recognize additions, deletions, modification, substitutions and/or other changes which will fall within the purview of the invention as defined in the following claims.

I claim:

1. A thermally efficient, protected membrane roofing system for insulating the interior of a building from ambient thermal cycling and for insuring water impermeable integrity of the building, said roofing system comprising:

a water impermeable membrane overlaying a roof deck or the like;

an array of factory assembled roofing panels positioned in a juxtaposed position across the roof deck and operably and overlaying said water impermeable membrane, said panels each including at least, a vapor barrier course, and an insulation course overlaying the vapor barrier course, said insulation course serving to protect and isolate the water impermeable membrane from external thermal cycling and said vapor barrier course serving to protect the insulation course from outwardly driven water vapor from the building or the surface of the water impermeable membrane;

a waterproof, but vapor permeable, tape bonded to the exterior surface of adjacent roofing, insulation panels to isolate the seam from penetration of surface water while concomitantly permitting the escape of water vapor from beneath the panels to the atmosphere through the peripheral seams of said roofing insulation panels, said waterproof tape including a plurality of conical extensions aligned along the edges of said tape for physical penetration into the outer surface of adjacent roofing panels; and a protective and retaining course overlaying the outer surface of the roofing panels to isolate the panels from ultraviolet degradation and retaining the panels in position upon the roofing deck.

2. A thermally efficient, protected membrane roofing system as defined in claim 1 and further comprising:

a course of adhesive overlaying the surface of said strip of waterproof tape having the plurality of conical extension, for binding the strip to the outer surface of the edges of the insulation course.

3. A thermally efficient roofing system as defined in claim 1 wherein:

the roof portion of the building is provided with one or more drains and the upper surface of said insulation course of the roofing panels uniformly slope toward said one or more drains.

4. A thermally efficient, protected membrane roofing system for insulating the interior of a building from ambient thermal cycling and for insuring water impermeable integrity of the building, said roofing system comprising:

a water impermeable membrane overlaying a roof deck or the like;

an array of factory assembled roofing panels positioned in a juxtaposed position across the roof deck, and operably overlaying said water impermeable membrane, said panels each including at least, a vapor barrier course, and an insulation course overlaying the vapor barrier course, said insulation course serving to protect and isolate the water impermeable membrane from external thermal cycling and said vapor barrier course serving to protect the insulation course from outwardly driven water vapor from the building or the surface of the water impermeable membrane;

a waterproof, but vapor permeable, tape bonded to the exterior surface of adjacent roofing, insulation panels to isolate the seam from penetration of surface water while concomitantly permitting the escape of water vapor from beneath the panels to the atmosphere through the peripheral seams of said roofing insulation panels, said waterproof tape comprising a plurality of conical extensions aligned along the edges of said taps for physical penetration into the outer surface of adjacent roofing panels;

the roof portion of the building is provided with one or more drains and the upper surface of said insulation course of the roofing panels uniformly slope toward said one or more drains; and a protective and retaining course overlaying the outer surface of the roofing panels to isolate the panels from ultraviolet degradation and retaining the panels in position upon the roofing deck.

5. A thermally efficient, protected membrane roofing system as defined in claim 4 and further comprising:

a course of adhesive overlaying the surface of said strip having the plurality of conical extensions for binding the strip to the outer surface of the edges of the insulation course; and a fabric course overlaying the opposite surface of said strip.

6. A thermally efficient, protected membrane roofing system for insulating the interior of a building from ambient thermal cycling and for insuring water impermeable integrity of the building, said roofing system comprising:

a water impermeable membrane overlaying a roof deck or the like;

an array of factory assembled roofing panels positioned in a juxtaposed position across the roof deck and operally overlaying said water impermeable membrane, said panels each including at least, an insulation course, said insulation course serving to protect and isolate the water impermeable membrane from external thermal cycling;

a vapor barrier course coextensive with said insulation course, said vapor barrier course serving to protect the insulation course from outwardly driven water vapor from the building; and an insulating drainage course bonded to said vapor barrier course and being operable to be placed against the water impermeable membrane, said insulating and drainage course comprising a course of generally homogeneous association of expanded polystyrene members coated with an outer film of latex bituminous emulsion wherein the coated polystyrene members are resistant to the penetration of water interiorly within the polystyrene members and concomitantly the latex bituminous emulsion being a waterproof adhesive such that the coated polystyrene members are bonded together at points of contact with random voids created throughout the association to render it both insulating and substantially porous to the passage of water;

a waterproof, but vapor permeable, tape bonded to the exterior surface of adjacent roofing, insulation panels to isolate the seam from penetration of surface water while concomitantly permitting the escape of water vapor from beneath the panels to the atmosphere through the peripheral seams of said roofing insulation panels; and a protective and retaining course overlaying the outer surface of the roofing panels to isolate the panels from ultraviolet degradation and retaining the panels in position upon the roof deck.

* * * * *